United States Patent [19]

Schneider

[11] Patent Number: 4,515,338

[45] Date of Patent: May 7, 1985

[54] COMBINATION EASEL HINGE AND HANGING DEVICE

[75] Inventor: Marshall Schneider, Newton Highlands, Mass.

[73] Assignee: Hallmark Cards, Inc., Kansas City, Mo.

[21] Appl. No.: 450,120

[22] Filed: Dec. 15, 1982

Related U.S. Application Data

[63] Continuation-in-part of Ser. No. 369,981, Apr. 19, 1982, abandoned.

[51] Int. Cl.[3] ..... A47B 97/04

[52] U.S. Cl. ..... 248/460; 248/558; 248/496

[58] Field of Search ..... 248/470, 471, 496, 558, 248/460

[56] References Cited

U.S. PATENT DOCUMENTS

| | | | |
|---|---|---|---|
| 2,016,942 | 10/1935 | Horwitt et al. . | |
| 2,448,580 | 9/1948 | Crosby . | |
| 2,483,114 | 9/1949 | Van Schoor et al. | 248/496 |
| 2,709,056 | 5/1955 | Jacquet . | |
| 3,165,290 | 1/1965 | Overton et al. . | |
| 3,251,572 | 5/1960 | Klitzner . | |
| 3,360,227 | 12/1967 | Overton et al. . | |
| 3,556,459 | 1/1971 | Summerville | 248/497 |
| 3,908,955 | 9/1975 | Frechtman | 248/470 |
| 3,990,670 | 11/1976 | Frechtman | 248/470 |
| 4,245,416 | 1/1981 | Maguire . | |
| 4,920,216 | 9/1981 | Gale | 248/470 X |

FOREIGN PATENT DOCUMENTS

| | | | |
|---|---|---|---|
| 515376 | 8/1955 | Canada | 248/470 |
| 2018581 | 10/1979 | United Kingdom | 248/470 |

*Primary Examiner*—William H. Schultz

*Attorney, Agent, or Firm*—Neuman, Williams, Anderson & Olson

[57] ABSTRACT

A convertible support device for displaying a framed article such as a picture either on a vertical surface such as a wall or on a horizontal surface in an easel-type display arrangement.

16 Claims, 17 Drawing Figures

FIG. 5
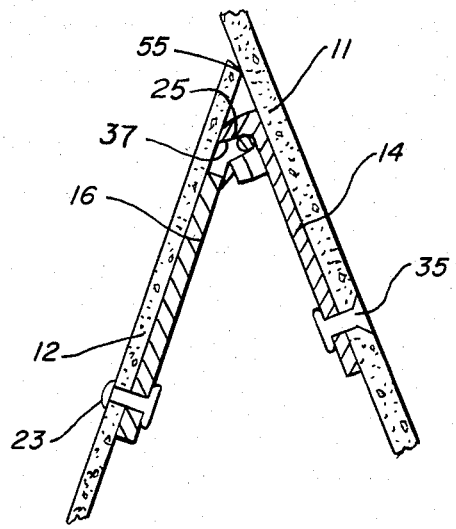
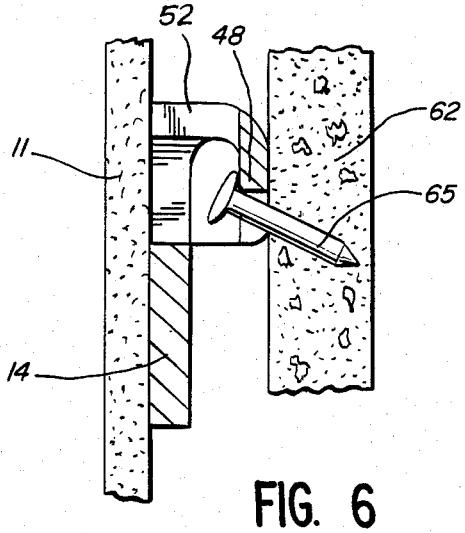
FIG. 6
FIG. 7
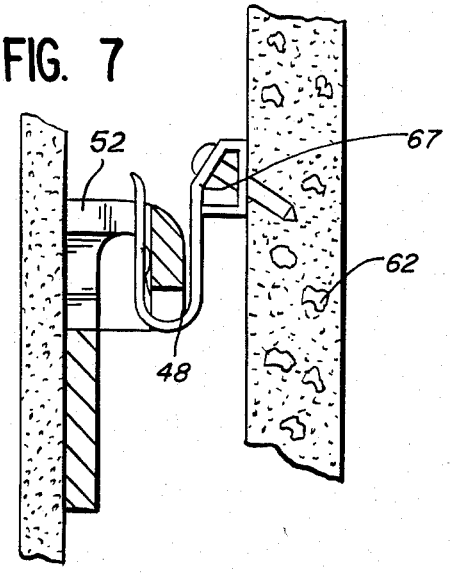
FIG. 8
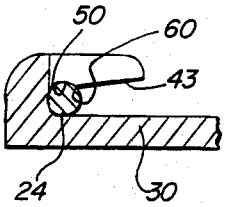
FIG. 9
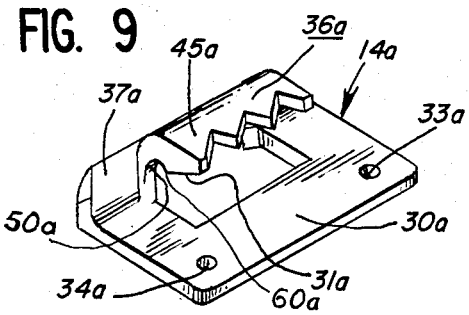
FIG. 10
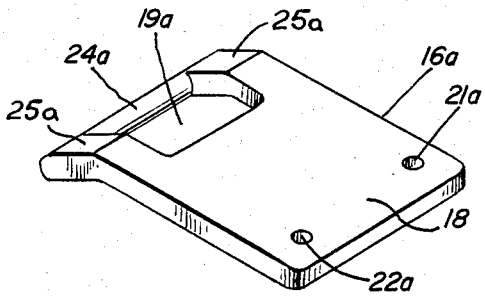

FIG. 11
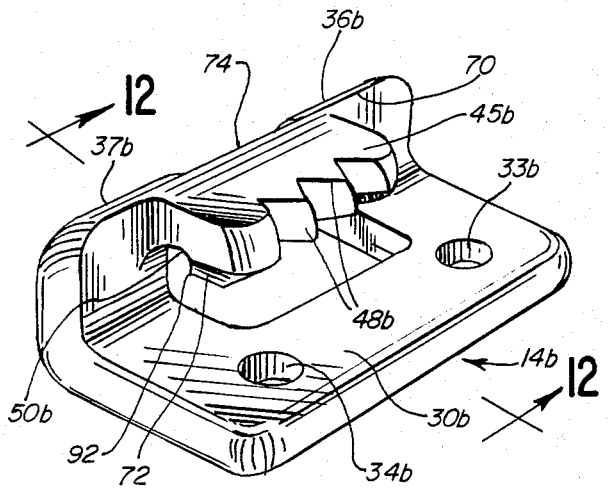
FIG. 13
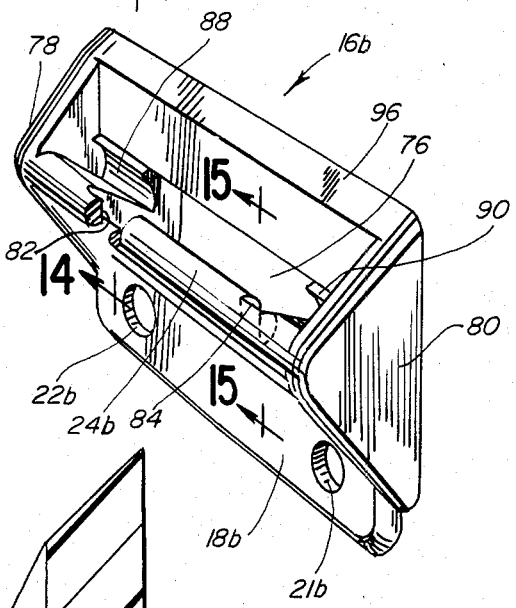
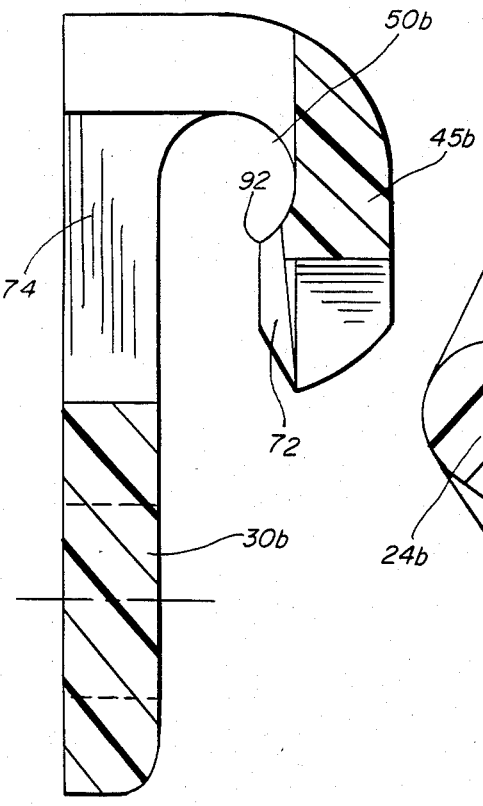
FIG. 12
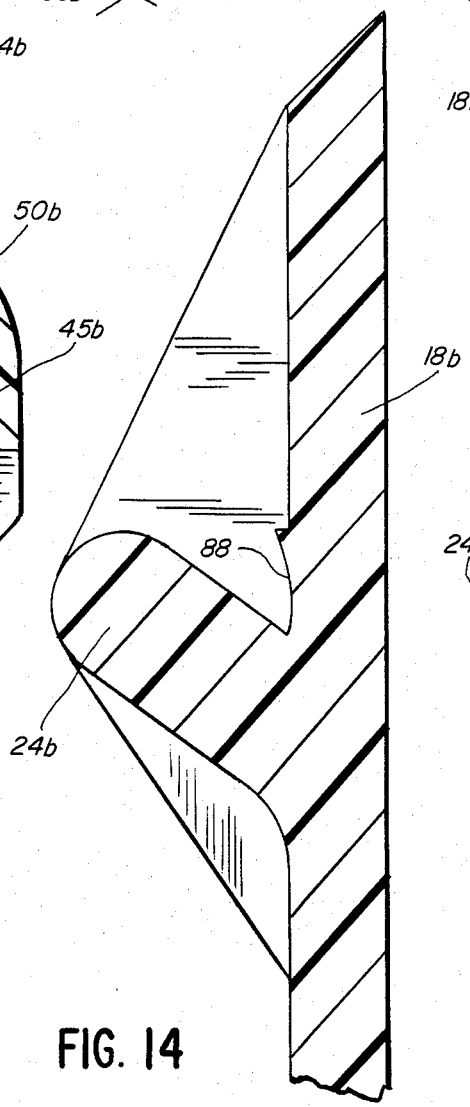
FIG. 14
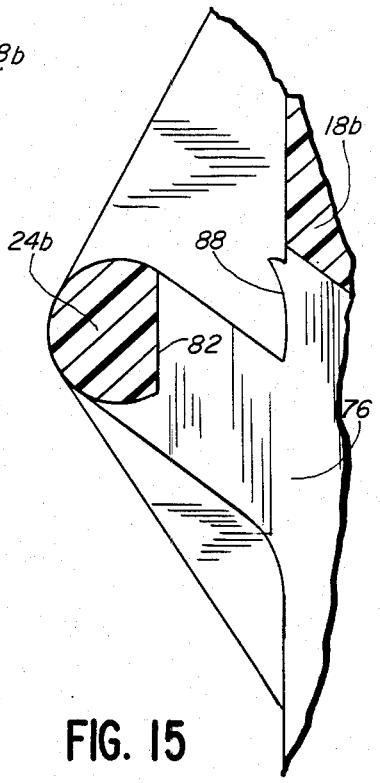
FIG. 15

COMBINATION EASEL HINGE AND HANGING DEVICE

RELATED APPLICATION

This application is a continuation-in-part application of pending application Ser. No. 369,981 filed Apr. 19, 1982, now abandoned.

This invention relates to a convertible article support device. More particularly, the invention relates to a device for supporting pictures or similar framed articles in a plurality of display modes.

BACKGROUND OF THE INVENTION

The capability of displaying pictures, plaques, mirrors and other ornamental articles in a variety of positions is highly desired. Thus, many times it is desirable to display such articles in vertical position such as by hanging on a wall. At other times it is desirable to display such articles on a stand in an easel-type display arrangement which rests on a horizontal surface. The ability to easily change the mode of support without employing two different and separate hanging attachments is of considerable advantage and convenience.

SUMMARY OF THE INVENTION

It is therefore a principal object of this invention to provide a convertible support device useful for displaying framed articles such as pictures on vertical or horizontal surfaces.

It is another object of this invention to provide a support device of simple construction which is advantageous for supporting an article to be displayed on an easel stand or by hanging on a vertical surface.

It is another object of the invention to provide a support device comprised of two complementary parts which are readily engaged to form a support for a framed article on a stand in an easel-type display.

An additional object of the invention is to provide a support device comprised of two complementary parts having means for retaining the components in engaged position after assembly but which permits easy disassembly.

It is a further object of the invention to provide a support device comprised of two complementary parts which can be readily engaged and disengaged by hand to permit display of a framed article on a horizontal surface or on a vertical surface.

It is still another object of the invention to provide a convertible support device for supporting an article to be displayed on either a horizontal or vertical surface, which device is of simple construction and can be fabricated from a variety of materials, including metals and plastic materials.

It is a further object of the invention to provide a hinge-type support device for supporting an article to be displayed in an easel-type display with the angle of opening of the support device being variable and controllable.

The convertible support device of this invention is comprised of two detachable components, one being a frame-hanging component adapted for attachment to the back of a frame which retains a picture, plaque, mirror or the like, with the other being a stand component adapted for attachment to an easel-type stand. The frame component is capable of use both in the hanging mode and in the standing mode. It is constructed so as to receive and retain the stand component by a detent type grip whereby the two components are securely but releasably engaged to form a device for supporting a framed article on an easel-type display arrangement. The frame and stand components can be readily disengaged from each other with the frame component being adapted for hanging the framed article on a vertical surface such as a wall.

The component which is attached to an easel stand is comprised of a bracket portion having mounting apertures therein and a generally cylindrical shaft element attached at one end thereof. The second component, which is attached to the back of a frame for retaining an article to be displayed, can be used by itself as a hanging device for a framed article or in engagement with the first component to form an easel-type support device. This frame component has a generally flat base portion having mounting apertures therein and a mantle element spaced from and overhanging the top portion thereof. The mantle element is provided with a longitudinal detent therein for receiving the cylindrical shaft element on said first component and has a saw-toothed hanger portion for engagement on a surface projection, such as a nail or U-shaped picture hook.

BRIEF DESCRIPTION OF THE DRAWINGS

The advantages and full nature of the invention will become apparent from the following detailed description and claims and the accompanying drawings wherein:

FIG. 5 is an enlarged sectional side view showing one manner in which the support device of the invention is maintained at a desired viewing angle.

FIG. 6 is a sectional view illustrating one manner in which the detachable frame component of the support device of the invention is utilized to support a framed article on a vertical surface.

FIG. 7 is a sectional view similar to FIG. 6 illustrating another manner in which the detachable frame component of the support device is utilized to support a framed article on a vertical surface.

FIG. 8 is a partial sectional view showing the interlocking gripping arrangement whereby the frame and stand components of the support device of the invention are retained in assembled condition.

FIG. 9 is a perspective view of another embodiment of the detachable frame component of the support device shown in FIG. 3.

FIG. 10 is a perspective view of another embodiment of the detachable stand component of the support device shown in FIG. 4.

FIG. 11 is a perspective view of another embodiment of a detachable frame component of the support device of the invention.

FIG. 12 is a view taken on the line 12—12 of FIG. 11.

FIG. 13 is a perspective view of another embodiment of the stand component of the support device of the invention.

FIG. 14 is a view taken on the line 14—14 of FIG. 13.

FIG. 15 is a view taken on the line 15—15 of FIG. 13.

DESCRIPTION OF PREFERRED EMBODIMENTS

Figure 1:
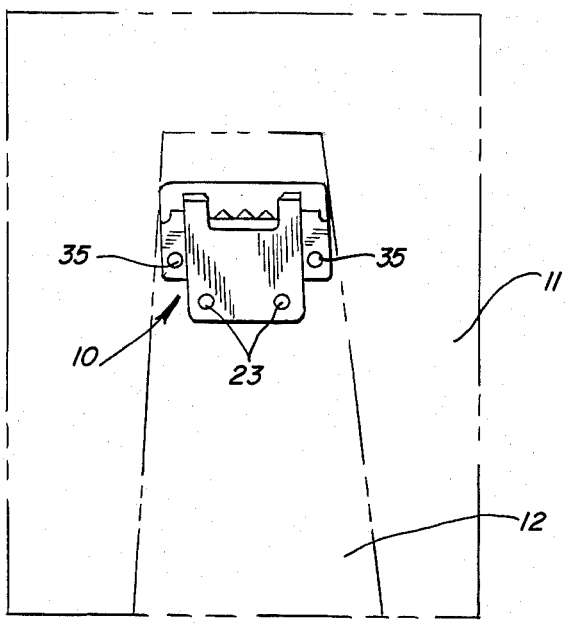
FIG. 1 is a plan view of the assembled support device of the invention showing its relative position when attached to the back of a frame for a picture or the like and an easel stand, the frame and stand being illustrated in phantom view by broken lines.
Figure 2:
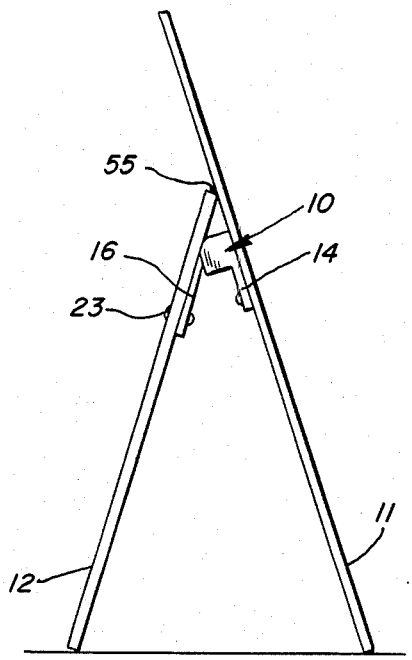
FIG. 2 is a side elevational view showing the relative positions of the engaged components of the support device of the invention with one attached to the back of a framed article and the other to an easel stand.

FIGS. 1 and 2 illustrate use of the support device of this invention generally indicated at 10 to support a picture frame 11 or the like on a prop or stand 12 in an upstanding easel-type display arrangement on a horizontal surface.

Figure 4:
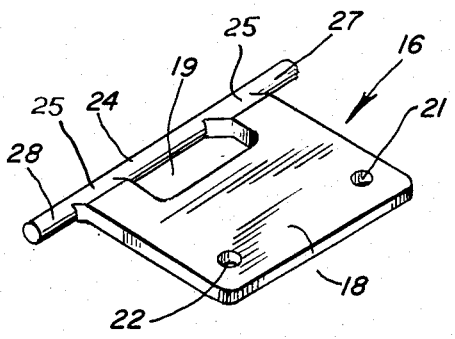
FIG. 4 is a perspective view of the stand component of the support device of the invention.

The framed article support device of this invention comprises two detachably engageable components, a frame component 14 and stand component 16. Both of these components can be formed of stamped metal or of readily available molded plastic materials. As shown in FIG. 4, stand component 16 comprises a generally flat bracket 18 having a cut-out portion 19 at the top thereof and two spaced mounting apertures 21 and 22 through which mounting rivets 23 pass for attachment of the bracket to an easel stand or prop. Flat stop faces 25 angularly connect the bracket 18 to a cylindrical pivot shaft member 24 and trunions 27 and 28 at an obtuse angle equal to the desired open angle for the easel and frame plus 90°.

Figure 3:
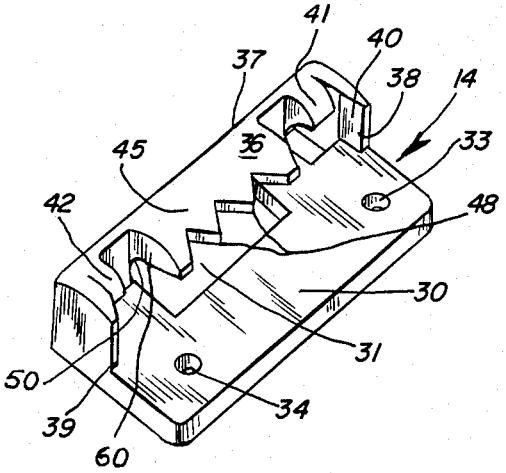
FIG. 3 is a perspective view of a detachable frame component of the support device of the invention.

FIG. 3 shows the details of construction of frame component 14 which is adapted for attachment to the back of a frame retaining an article such as a picture, plaque, mirror or the like. Frame component 14 has a generally flat base 30 which is provided at the top with a cut-out portion 31 and two spaced mounting apertures 33 and 34 through which mounting rivets 35 are passed for mounting the base on the back of a frame. A hanging mantle element designated generally by the numeral 36 is joined to the base plate 30 at the upper end and overhangs the upper portion of the base and defines therewith means for engaging and retaining the two detachable components of the support device in assembled condition.

In the embodiment of the hanging frame component shown in FIG. 3, the hanging mantle 36 is formed by top wall 37 and two sides 38 and 39, all of which are joined to base plate 30 in perpendicular planes thereto. The inward faces of sides 38 and 39 are beveled as at 40 to guide during assembly the trunions 27 and 28 on stand component 16 into the grip detent area in frame hanging component 14. The side walls 38 and 39 also serve to prevent lateral movement of the pivot shaft when in engaged position.

Bearing members 41 and 42 extend downwardly from the front edge of top wall 37 at opposite ends thereof in a plane parallel to base plate 30. The inner surfaces of bearing members 41 and 42 are declined tangentially to the base plate 30 as at 43 (FIG. 8) to form a ramp-type entrance for the trunnions 27 and 28 on stand component 16. Also extending downwardly from the front edge of the intermediate portion of top wall 37 is zig-zag hanger 45 which is provided with a series of saw-teeth 48 on its lower edge. The inner surface of hanger 45 is declined in tangential relationship with the base to form a bearing surface for the pivot shaft 24 of stand component 16. The top portion of the inner surface of hanger element 45 is provided with a longitudinal semi-circular cut-away portion 50 which serves as a journal bearing for pivot shaft 24 carried by stand component 16. Slot 52 in top wall 37 is provided for engagement with a U-shaped picture hook when the frame component is used alone to display the framed article on a wall.

To display a framed article in an easel-type arrangement, frame component 14 is attached to the back of a frame 11 such as by mounting rivets 35. In similar manner, the stand component 16 is attached to an easel stand or prop 12 by means of mounting rivets 23. The two components of the support device can be joined to the frame and easel stand by means other than rivets, such as, for example, screws, staples integrally headed over pins, adhesives and so forth. Alternatively, the frame component and stand component can be formed integral with the frame and easel stand such as by injection molding. The detachable components are mounted on the easel stand and frame at an elevation such that when the two components are in engaged position the easel prop or stand projects a sufficient distance so that the top edge thereof contacts the frame at point 55 thereby serving to fix the plane in which the framed article is displayed.

After attachment of the detachable components 14 and 16 to frame and easel stand, respectively, they are brought into engaged position with each other. This is accomplished by aligning stand component 16 on the base plate 30 of frame hanging component 14 and sliding it upwardly so that the pivot shaft 24 enters the hanging mantle 36. As component 16 continues to be moved upwardly further into the mantle guided by the beveled inner faces of sides 38 and 39, the trunnions 27 and 28 engage the bearing members 41 and 42 and pivot shaft 24 engages the hanger 45. Further movement into the hanging mantle with some slight force causes the zig-zag hanger 45 to deflect upwardly somewhat permitting the pivot shaft 24 to pass the retaining point or detent 60 and to seat in the cut-away bearing 50. At this time the hanger 45 returns to its normal position trapping pivot shaft 24 in the bearing 50. Stop faces 25 abut flush against the top wall 37 to control and maintain a desired open angle between the easel and frame. This arrangement in concert with the easel stand 12 contacting the frame 11 as at 55 limits pivotal movement between the engaged components and insures that the framed article is displayed at a desired viewing angle. The support device of the invention is thus assembled with the detachable components thereof supporting a framed article on an easel-type display.

When and if it is desired to vary the mode of display, disengagement of the framed article from the easel stand is accomplished simply by pulling stand component 16 away from the frame component 14 with sufficient force to cause hanger 45 to deflect upwardly a sufficient amount to permit pivot shaft 24 to become disengaged from detent 60. The framed article can then be hung on a vertical surface such such as a wall 62 by hanging on a nail 65 or on a U-shaped picture hook 67. As shown in FIG. 6, nail 65 is driven into the wall with the saw-toothed edge 48 of hanger 45 resting on the nail. As shown in FIG. 7, the U-shaped picture hook 67 is attached to a wall with one leg of the hook passing upwardly through slot 52 and the saw-toothed edge 48 of the hanger resting in the crook of the picture hook.

FIG. 9 illustrates another embodiment of the frame component designated 14*a* which is of more simple construction than is the frame component shown in FIG. 3. In this embodiment the hanging mantle 36*a* includes only the intermediate zig-zag hanger 45*a* and does not include additional bearing members or side walls.

FIG. 10 illustrates another embodiment of the stand component designated 16*a*. In this embodiment an angularly disposed integral top portion 24*a* of bracket 18*a* serves the same function as does shaft 24 shown in FIG. 4. Also, the angularly disposed portion 24*a* does not have projecting trunnions as in the previous embodiment. Assembly and disassembly and use of the frame and stand components illustrated in FIGS. 9 and 10, respectively, is as previously described.

A particularly preferred and advantageous support device in accordance with this invention is illustrated in FIGS. 11 through 17 of the drawings.

According to this preferred embodiment, frame component 14*b* is adapted for attachment to the back of a frame retaining article such as a picture, plaque, mirror or the like by means of mounting apertures 33*b* and 34*b* provided in the generally flat base 30*b*. Mounting rivets or screws can be passed through apertures 33*b* and 34*b* for mounting the base on the back of a frame. A hanging mantle element 36*b* is joined to the base plate 30*b* at the upper end and overhangs the upper portion of the base to define therewith means for engaging and retaining the two detachable components of the support device in assembled relationship. The top wall 37*b* extends in a substantially perpendicular plane from flat plate 30*b* and its top surface is curved at the forwardly projecting terminus as at 70. Extending downwardly from the center portion of the top wall 37*b* is zig-zag hanger 45*b* which is provided with a series of saw-teeth 48*b* on the lower edge. At each end of the hanger element there is provided an inwardly projecting lip 72. The top portion of the inner surface of hanger 45*b* is provided with a longitudinal semicircular cut-away portion 50*b* which serves as a journal bearing for a pivot shaft on the stand component. An intermediate cut-out portion 74 is provided in base plate 30*b* and top wall 37*b* which permits the frame to be displayed on a vertical surface, such as a wall, as previously described in conjunction with FIGS. 6 and 7.

The stand component 16*b* which is adapted to be used with frame component 14*b* is shown in FIG. 13. Stand component 16*b* comprises a generally flat bracket 18*b* having a center cut-out portion 76 and two spaced mounting apertures 21*b* and 22*b* through which mounting rivets or screws are passed to attach the stand component 16*b* to an easel stand or prop. Triangularly shaped end walls 78 and 80 extend perpendicularly from the distal ends of the flat bracket 18*b*. Extending between and joined to the end walls is a generally cylindrical pivot shaft 24*b*. The pivot shaft 24*b* is provided with two flat face sections 82 and 84 which are so spaced on the pivot shaft as to mate with the inwardly projecting lips 72 on the hanger element of the frame component. Two curved projections 88 and 90 are spaced apart on the inner surface of the flat bracket 18*b* which serve to lock the frame component and stand component in assembled condition as will be described.

To display a framed article in an easel-type arrangement frame component 14*b* is attached to the back of a frame 11 such as by mounting rivets 35*b*. In similar manner the stand component 16*b* is attached to an easel stand or prop 12*b* by means of rivets 23*b*. The frame component and stand component can, of course, be attached by means other than rivets, such as screws, adhesives, etc.

Figure 17:
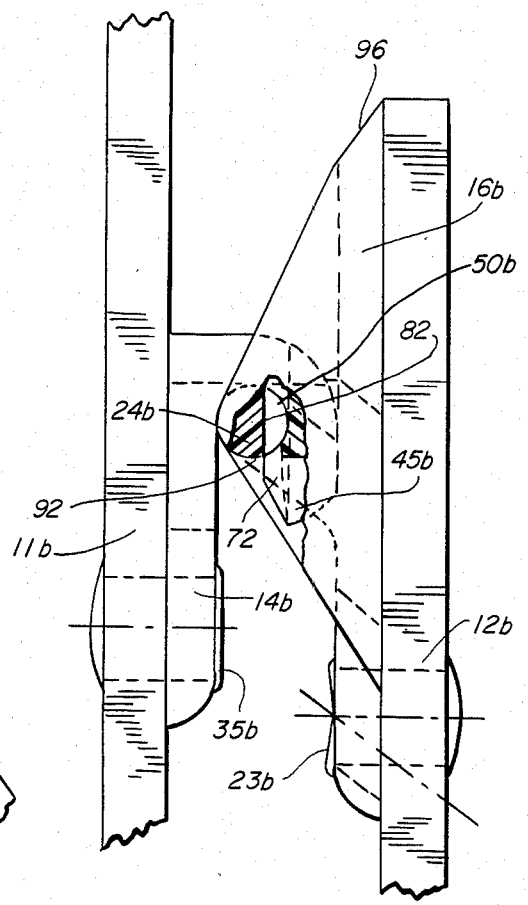
FIG. 17 is an enlarged sectional side view partially broke away showing the relationship of the frame and stand components of FIGS. 11 and 13, respectively, when the stand and frame are in a closed or non-extended position.

After attachment of the components 14*b* and 16*b* to frame and easel stand, respectively, they are brought into engaged position with each other. This is accomplished by aligning the frame and stand components so that the flat faces 82 and 84 on pivot shaft 24*b* are in a plane substantially parallel with the inner face of lip 72 as shown in FIG. 17, so as to permit the pivot shaft to pass retaining point 92 and to seat in the cut-away bearing 50*b* within the frame component. At this time the easel is in a closed (parallel) position with the frame and easel stand lying in substantially parallel planes (FIG. 17).

Figure 16:
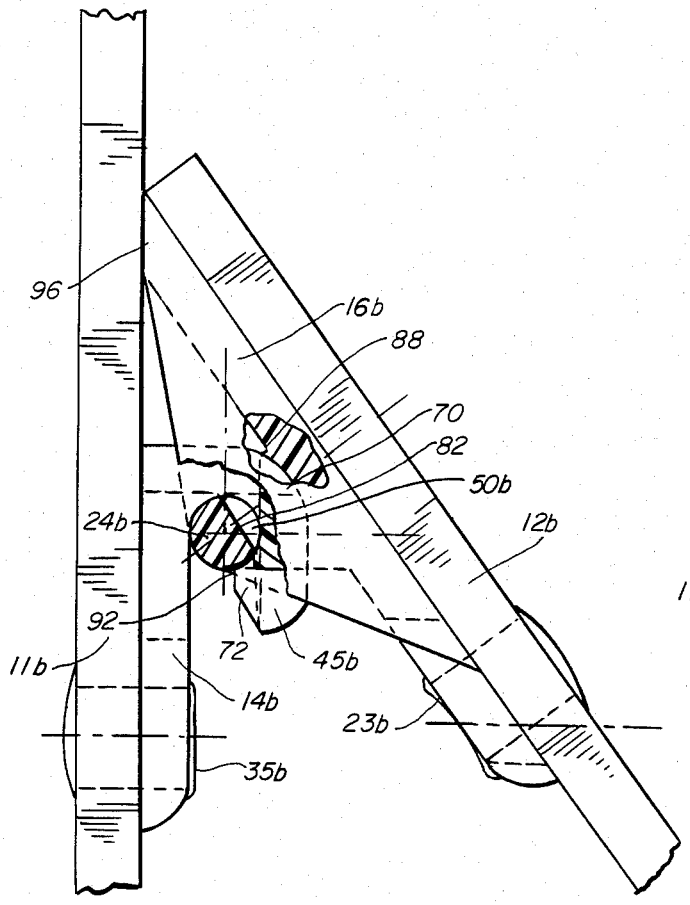
FIG. 16 is an enlarged sectional side view partially broken away showing the relationship of the frame and stand components of FIGS. 11 and 13, respectively, when the stand and frame are in an open or extended position.

When the pivot shaft 24*b* is seated in journal bearing 50*b*, the easel can then be moved to an open position as shown in FIG. 16. As soon as the easel is moved into an open position, the flat faces 82 and 84 are no longer aligned with lips 72 and the pivot shaft cannot be withdrawn from the hanging mantle thereby locking the frame component and stand component in assembled condition. Also, as the easel is moved into open (angled) position, the curved projections 88 and 90 on the flat bracket 18B begin to wrap over the radius on the curved end section 70 of the hanging mantle. This provides additional locking power to retain the frame and stand components in locked assembled position and keeps the components positively engaged when a force is applied to separate them.

When the easel is in fully open position, the top edge 96 of the stand component acts as a positive stop against the frame to fix the plane in which the framed article is displayed.

To disengage the frame and stand components one need only to close the easel as shown in FIG. 17 and disengage the pivot shaft from the hanging mantle.

The support device of this invention is of simple construction and can be formed of readily available materials including plastic materials. There are only two components which can be readily engaged or disengaged by hand and no delicate hinge parts or pins are needed. When the two components are in engaged position, a framed article is displayed at a desired viewing angle in an easel-type display arrangement. However, the easel stand can be folded to lie flat against the frame when desired, such as during storage. Also, the design of preferred embodiments of the invention is such as to prevent the frame and easel stand from separating unless in a properly aligned position. Often there is a natural tendency among users to pull on the easel stand in order to disengage the frame backing. In such instances the positive locking means disclosed prevents the frame and stand from separating.

Those modifications and equivalents which fall within the spirit of the invention are to be considered a part thereof.

What is claimed is:

1. An article support device comprising two detachably engageable components which when assembled in engaged position are adapted for supporting a framed article on a horizontal surface in an easel-type display arrangement, a first component being adapted for attachment to an easel stand and being comprised of a bracket portion having mounting apertures therein and a generally cylindrical shaft element attached thereto, a second component being adapted for attachment to the back of a frame for retaining an article to be displayed and being adapted for use by itself as a hanging device for a framed article or in engagement with said first component to form an easel-type support device, said second component having a generally flat base having mounting apertures therein and a mantle element spaced from and overhanging the top portion of said base, said mantle element being provided with a longitudinal bearing therein for receiving the cylindrical shaft element on said first component and having a saw-toothed hanger portion for engagement on a surface projection.

2. An article support device in accordance with claim 1 wherein the mantle element is spaced from the base of the second component at a distance that the inner surface opposing said base forms a bearing surface for said cylindrical shaft on said first component.

3. An article support device in accordance with claim 1 wherein the inner surfaces of the mantle element opposing the base are tangentially declined with respect to said base to form a ramp-type entrance for said cylindrical shaft.

4. An article support device in accordance with claim 1 wherein the generally cylindrical shaft element carries on distal ends thereof a pair of trunions which engage bearing surfaces on said mantle element.

5. An article support device in accordance with claim 1 wherein stop members angularly connect the generally cylindrical shaft element to said bracket portion at an obtuse angle equal to a set open angle for the easel and frame plus 90°.

6. An article support device in accordance with claim 1 wherein the base of said second component is provided with a plurality of mounting apertures for receiving mounting means and is cut out near the top portion thereof permitting it to be hung on a surface projection.

7. An article support device in accordance with claim 1 wherein the top wall forming the mantle element is slotted to receive a leg of a U-shaped wall picture hanger.

8. An article support device in accordance with claim 1 wherein the mantle element is formed with two beveled side walls which prevent lateral movement of the cylindrical shaft when the two components are in engaged position.

9. An article support device in accordance with claim 1 wherein at least two inner surfaces of the mantle element opposing the base have inwardly projecting lips thereon.

10. An article support device in accordance with claim 1 wherein the terminus of said mantle element has a curved top surface.

11. An article support device in accordance with claim 1 wherein the generally cylindrical shaft element attached to said first component has at least two flat face surfaces thereon spaced so as to pass the inwardly projecting lips on said mantle element when said first and second components are being assembled or disassembled.

12. An article support device in accordance with claim 1 wherein at least two curved inwardly projecting surfaces are provided on the inner surface of the bracket portion of said first component.

13. An article support device in accordance with claim 1 wherein at least two inner surfaces of the mantle element opposing the base have inwardly projecting lips thereon and the terminus of said mantle element has a curved top surface and wherein the generally cylindrical shaft element attached to said first component has at least two flat face surfaces thereon spaced so as to pass the inwardly projecting lips on said mantle element when said first and second components are being assembled or disassembled and wherein at least two curved inwardly projecting surfaces are provided on the inner surface of the bracket portion of said first component.

14. In combination with an easel stand and a frame for retaining an article to be displayed, an article support device comprising two detachably engageable components adapted for supporting a framed article on a horizontal surface in an easel-type display arrangement, a first component attached to the easel stand and being comprised of a bracket portion having mounting apertures therein and a generally cylindrical shaft element attached thereto, a second component attached to the back of said frame and having a generally flat base having mounting apertures therein and a mantle element spaced from and overhanging the top portion of said base, said mantle element being provided with a longitudinal bearing in which the cylindrical shaft element on said first component is received and having a saw-toothed hanger portion for engagement on a surface projection, the said first and second components being attached to said easel stand and said frame respectively at locations below the top edges thereof permitting point contact between said easel stand and said frame at a desired angle relative to each other.

15. The combination of claim 14 wherein stop members angularly connect the generally cylindrical shaft element to said bracket portion at an obtuse angle equal to a set open angle for the easel and frame plus 90°.

16. In combination with an easel stand and a frame for retaining an article to be displayed, an article support device comprising two detachably engageable components adapted for supporting a framed article on a horizontal surface in an easel-type display arrangement, a first component attached to the easel stand and being comprised of a bracket portion having mounting apertures therein and a generally cylindrical shaft element attached thereto, a second component attached to the back of said frame and having a generally flat base having mounting apertures therein and a mantle element spaced from and overhanging the top portion of said base, said mantle element being provided with a longitudinal bearing in which the cylindrical shaft element on said first component is received and having a saw-toothed hanger portion for engagement on a surface projection, the said first and second components being attached to said easel stand and said frame respectively at locations below the top edges thereof permitting point contact between said easel stand and said frame at a desired angle relative to each other and wherein at least two inner surfaces of the mantle element opposing the base have inwardly projecting lips thereon and the terminus of said mantle element has a curved top surface and wherein the generally cylindrical shaft element attached to said first component has at least two flat face surfaces thereon spaced so as to pass the inwardly projecting lips on said mantle element when said first and second component are being assembled or disassembled and wherein at least two curved inwardly projecting surfaces are provided on the inner surface of the bracket portion of said first component.

* * * * *